US007639931B2

(12) United States Patent
Tsai

(10) Patent No.: US 7,639,931 B2
(45) Date of Patent: Dec. 29, 2009

(54) VERTICAL WATER HEATER

(76) Inventor: Hua-Hsin Tsai, No. 105, Jhongyang Rd., Jioucyong Village, Linnei Township, Yunlin County (TW)

( * ) Notice: Subject to any disclaimer, the term of this patent is extended or adjusted under 35 U.S.C. 154(b) by 294 days.

(21) Appl. No.: 11/902,135

(22) Filed: Sep. 19, 2007

(65) Prior Publication Data

US 2009/0074391 A1 Mar. 19, 2009

(51) Int. Cl.
*F24H 1/20* (2006.01)

(52) U.S. Cl. ..... 392/451; 392/450; 392/452; 392/455

(58) Field of Classification Search ..... None
See application file for complete search history.

(56) References Cited

U.S. PATENT DOCUMENTS

| | | | | | |
|---|---|---|---|---|---|
| 846,544 | A * | 3/1907 | Bremer et al. | ..... | 392/487 |
| 1,409,019 | A * | 3/1922 | Parnell-Smith | ..... | 392/489 |
| 1,671,677 | A * | 5/1928 | Keeton | ..... | 392/489 |
| 1,791,095 | A * | 2/1931 | Hicks | ..... | 392/462 |
| 1,938,434 | A * | 12/1933 | Lithman | ..... | 392/378 |
| 2,589,566 | A * | 3/1952 | Neth et al. | ..... | 392/479 |
| 2,784,291 | A * | 3/1957 | Harney | ..... | 392/452 |
| 2,813,964 | A * | 11/1957 | Cerulli | ..... | 392/489 |
| 4,567,350 | A * | 1/1986 | Todd Jr. | ..... | 392/486 |
| 5,129,034 | A * | 7/1992 | Sydenstricker | ..... | 392/486 |
| 5,371,830 | A * | 12/1994 | Wachenheim | ..... | 392/487 |
| 5,559,924 | A * | 9/1996 | Kadotani et al. | ..... | 392/483 |
| 5,740,315 | A * | 4/1998 | Onishi et al. | ..... | 392/489 |
| 7,190,894 | B2 * | 3/2007 | Chamberlain, Jr. | ..... | 392/490 |
| 7,421,194 | B2 * | 9/2008 | Lin | ..... | 392/411 |
| 2004/0131346 | A1 * | 7/2004 | Chamberlain, Jr. | ..... | 392/490 |
| 2009/0060482 | A1 * | 3/2009 | Tsai | ..... | 392/485 |
| 2009/0067824 | A1 * | 3/2009 | Tsai | ..... | 392/478 |

* cited by examiner

*Primary Examiner*—Thor S Campbell
(74) *Attorney, Agent, or Firm*—Rosenberg, Klein & Lee

(57) ABSTRACT

A vertical water heater includes a machine body installed therein with plural quartz heating tubes respectively composed of a quartz external tube having its opposite ends sealed and a quartz internal tube positioned in the quartz external tube. Each quartz internal tube is provided with a remote-infrared-ray heating member in the interior and has one end connected with an electrode terminal. Each quartz external tube has its lower wall bored with plural water intakes 212 and its upper wall bored with vapor vents. The machine body has its bottom provided with a water inlet and a water outlet and its topside bored with an exhaust vent having a pressure release valve assembled thereon. The vertical water heater carries out heat conduction by vapor and by light and heat radiation, impossible to produce water stains and able to economize energy.

8 Claims, 3 Drawing Sheets

VERTICAL WATER HEATER

BACKGROUND OF THE INVENTION

1. Field of the Invention

This invention relates to a vertical water heater, particularly to one having a machine body installed therein with a plurality of quartz heating tubes respectively bored with water intakes and vapor vents. The vertical water heater carries out heat conduction by vapor and by light and heat radiation, so it is impossible to produce water stains and able to economize energy.

2. Description of the Prior Art

Most people are used to taking a bath with hot water in a cold winter to make themselves comfortable and refreshing.

Conventional water heaters are generally classified into electric water heaters and gas water heaters. Substantially, most families prefer using electric water heaters instead of gas water heaters because gas water heaters are likely to produce carbon monoxide and cause an accident of toxicosis.

The conventional water heater is provided with plural heating members in the interior of its metal casing to be electrically connected for producing heat energy by metal conductors for carrying out water heating. However, the metal conductors are liable to produce water stains on the surfaces to influence effect of heat conduction, thus wasting electric energy and shortening service life of the water heater.

SUMMARY OF THE INVENTION

The objective of this invention is to offer a vertical water heater provided with a machine body having its external wall disposed with a heat-preserving double layer. The machine body is transversely assembled with a support frame, and the support frame and the lower portion of the machine body are respectively and correspondingly mounted with plural assembly bases. Plural quartz heating tubes are respectively assembled between two corresponding assembly bases, respectively composed of a quartz external tube having its opposite ends sealed and a quartz internal tube positioned in the quartz external tube. Each quartz internal tube is installed therein with a remote-infrared-ray heating member and has one end connected with an electrode terminal. The quartz external tube has its lower wall bored with plural water intakes and its upper wall bored with vapor vents. Further, the machine body has its bottom provided with a water inlet and a water outlet and its topside bored with an exhaust vent assembled thereon with pressure release valve, with the water inlet communicating with a water intake tube in the machine body. The water intake tube has its lower end formed with an expanded portion having its wall bored with numerous through holes, having its top end communicating with a transverse tube disposed with plural water spraying members. The water outlet of the machine body communicates with a water outflow tube inside the machine body. The water outflow tube is a cone-shaped tube with a wide upper portion and a narrow lower portion, having its wall bored with numerous through holes gradually increased from the lower side to the upper side. By so designing, the vertical water heater carries out heat conduction by vapor and by light and heat radiation, impossible to produce water dirt and able to economize energy.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
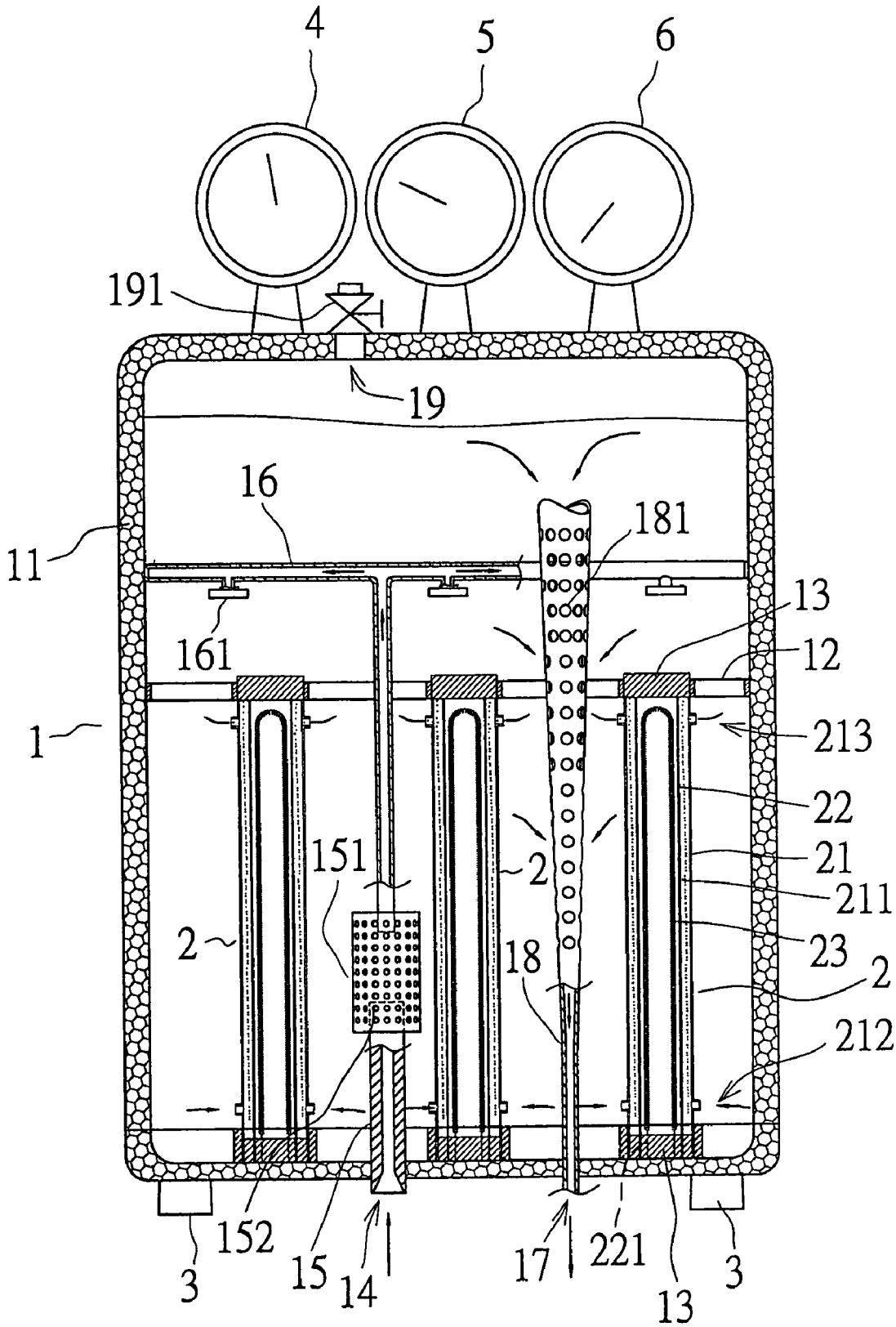
FIG. 1 is a side cross-sectional view of a vertical water heater in the present invention.
Figure 2:
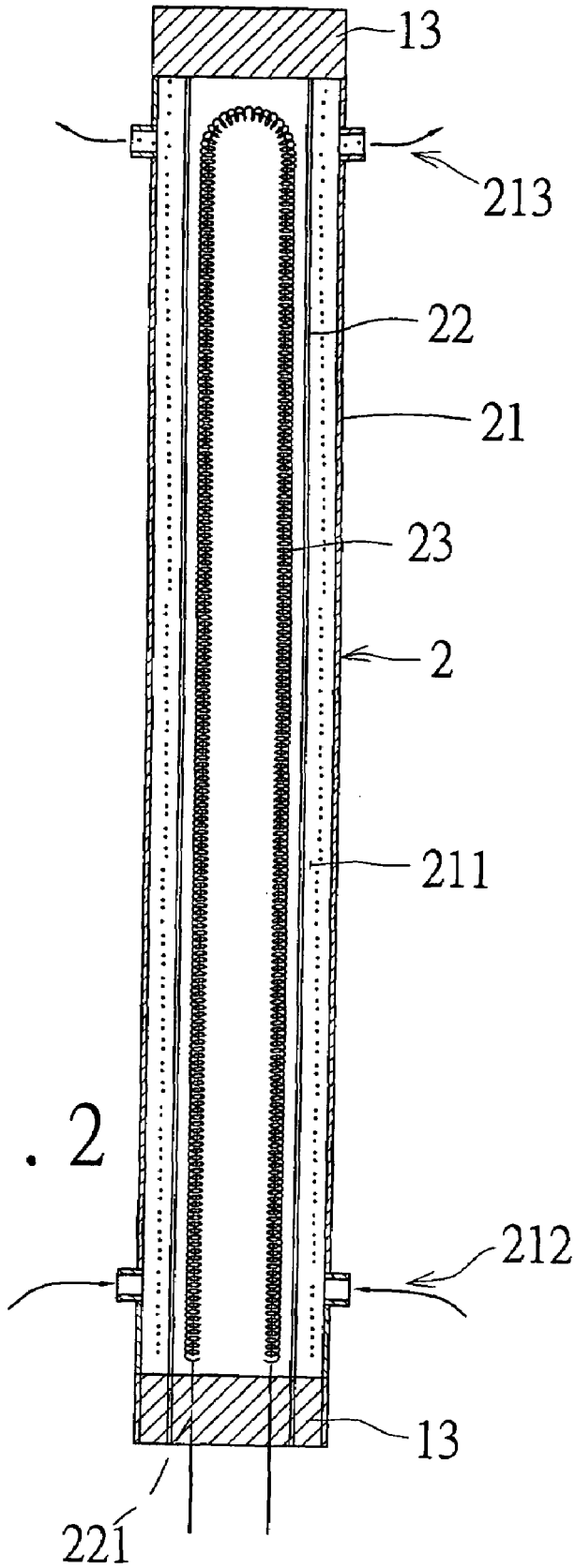
FIG. 2 is a partial magnified side cross-sectional view of the vertical water heater in the present invention.

A preferred embodiment of a vertical water heater in the present invention, as shown in FIGS. 1 and 2, includes a machine body 1 and a plurality of quartz heating tubes 2 as main components combined together.

The machine body 1 has its external wall provided with a heat-preserving sandwich layer 11 and is transversely fixed with a support frame 12 in the interior. The support frame 12 and the lower side of the machine body 1 are respectively and correspondingly secured thereon with plural assembling bases 13.

The quartz heating tubes 2 are respectively positioned between two corresponding assembly bases 13, respectively composed of a quartz external tube 21 having its opposite ends sealed and a quartz internal tube 22 positioned in the quartz external tube 21. Each quartz internal tube 22 is installed therein with a remote-infrared-ray heating member 23 made of carbon fiber and has one end connected with an electrode terminal 221 to be electrically connected to let the remote-infrared-ray heating member 23 produce remote infrared rays and heat energy. The quartz external tube 21 has its opposite ends combined with the quartz internal tube 22 by thermal compression, letting the electrode terminal 221 of the quartz internal tube 22 extended out of the quartz external tube 21 and having an accommodating space 211 formed between the quartz external tube 21 and the quartz internal tube 22. Further, each quartz external tube 21 has its lower sidewall bored with plural water intakes 212 and its upper sidewall bored with plural vapor vents 213. The machine body 1 further has its underside fixed with foot bases 3 and its bottom bored with a water inlet 14 communicating with a water intake pipe 15 inside the machine body 1. The water intake pipe 15 has its lower end formed with an expanded portion 151 having its wall bored with numerous through holes 152 to enable water in the water intake pipe 15 to flow into the machine body 1. The water intake pipe 15 has its top end communicating with a transverse tube 16 disposed with plural water spraying members 161 communicating with the transverse tube 16. Thus, when feeding water is large in quantity, the water flowing into the transverse tube 16 will spray out through the water spraying 161 and get into the machine body 1 to enlarge a contact face of water with the quartz heating tubes 2 and vapor for quickly raising water temperature. Furthermore, the machine body 1 has its bottom bored with a water outlet 17 communicating with a water-outflow tube 18 in the machine body 1. The water outflow tube 18 is a conical tube with a wide upper portion and a lower portion and has its wall bored with lots of through holes 181 gradually increased in number from below to above so that comparatively large amount of water can be poured into the upper portion of the water outflow tube 18 so as to increase the pressure of water outflow. In addition, the machine body 1 has its upper outside assembled with a pressure meter 4, a water level meter 5 and a temperature meter 6 and its top end bored with an exhaust vent 19 provided thereon with a pressure release valve 191 communicating with the exhaust vent 19 for releasing excessive pressure from the machine body 1 so as to avoid causing an accident. The vertical water heater can be automatically controlled to stop water from flowing into the machine body 1 when water level is too high and controlled to stop heating when temperature is excessively high.

Figure 3:
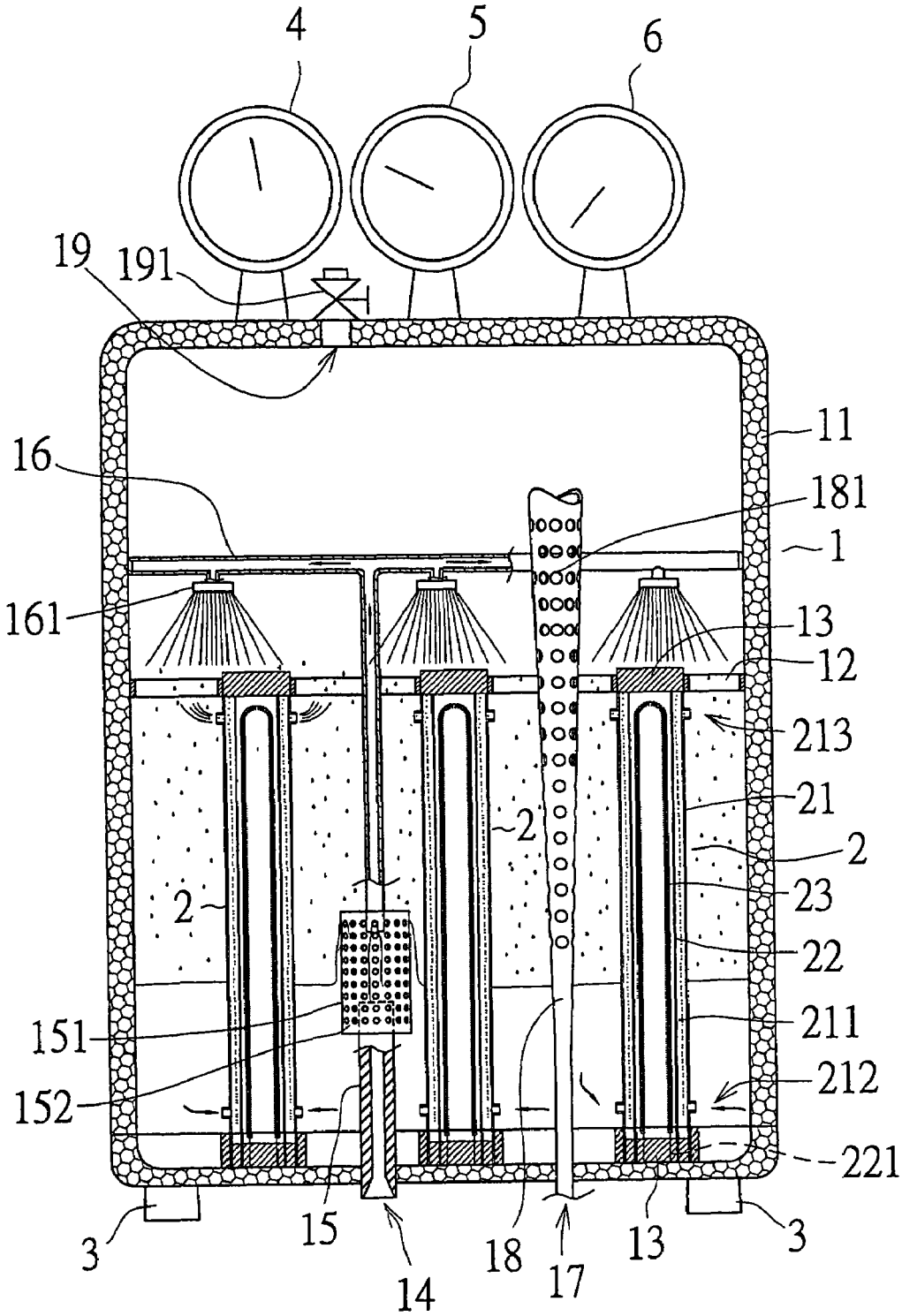
FIG. 3 is side cross-sectional view of the vertical water heater having its sprayers sprinkling water in the present invention.

In using, referring to FIG. 1, water is supplied to flow into the water heater through the water outlet 14, and then flow through the expanded member 151 of the water intake tube 15 and into the machine body 1 through the through holes 152 in the wall of the expanded portion 151. The machine body 1 is installed inside with plural quartz heating members 2 respectively composed of the quartz external tube 21 and the quartz internal tube 22 positioned in the quartz external tube 21, and the quartz external tubes 21 have their lower walls respectively bored with a plurality of water intakes 212; therefore, when water flowing into the machine body 1 reaches a proper water level, it will flow into the accommodating space 211 between the quartz external tube 21 and the quartz internal tube 22 through the water intakes 212 of the quartz external tubes 21. Since the remote-infrared-ray heating members 23 in the quartz internal tubes 22 can produce light and heat radiation and heat energy with extremely high temperature; therefore, the water flowing into the accommodating space 211 will be quickly boiled, vaporized and then exhausted out to get into the machine body 1 through the vapor vents 213 in the upper walls of the quartz external tubes 21. Thus, temperature of the water in the machine body 1 will rise quickly by heating of light and heat radiation and by hot water convection as well as by heated vapor, having effect of energy saving. The water flowing into the accommodating space 211 between the quartz external tube 21 and the quartz internal tube 22 is heated and vaporized by the remote-infrared-ray heating members 23 so it is impossible to produce water dirt. Further, referring to FIG. 3, when the amount of feeding water through the water inlet 14 is too large to be all exhausted out through the through holes 152 of the expanded member 151 at the lower end of the water intake tube 15, the water will flow upward and get into the transverse tube 16 at the upper end of the water intake tube 15 to be sprayed out through the spraying members 161 of the transverse tube 16 to get into the machine body 1 for increasing a contact face of feeding water with the vapor in the machine body 1 so as to quickly heighten temperature of the fed-in water. Furthermore, hot water in the machine body 1 is to flow out for use through the water outlet 17. The water outlet 17 communicates with the water outflow tube 18 in the machine body 1. The water outflow tube 18 is a conical tube with a wide upper portion and a narrow lower portion and has its sidewall bored with numerous through holes 181 gradually increased in number from the lower portion to the upper portion. By so designing, comparatively large quantity of water can be poured into the upper portion of the water outflow tube 18 to increase water outflow pressure. Thus, by increase of the water outflow pressure of the water outflow tube 18 and by the vapor exhausted out through the vapor vents 213 of the quartz external tubes 21 to heighten the water vapor pressure in the machine body 1, hot water in the water outflow tube 18 can be forced to flow out for use more smoothly and conveniently.

As can be understood from the above description, this invention has some advantages described as follows.

1. Water pressure in the machine body can rise quickly by heating by means of light and heat radiation of the remote-infrared-ray heating members and by heating of hot water convection as well as by heating of vapor, having effect of quickly heightening water pressure and economizing energy.

2. Water flowing into the accommodating space between the quartz external tube and the quartz internal tube is heated and vaporized by the remote-infrared-ray heating member and carries out heat conduction by vapor, and by light and heat radiation, so it is impossible to produce water dirt, able to prolong the service life of the vertical water heater.

3. As mentioned above, the vertical water heater of this invention will not produce water dirt so it is able to carry out heat conduction normally, having excellent effect of energy saving.

4. The remote-infrared-ray heating members are always heated to maintain extremely high temperature so water flowing into the accommodating space can quickly be boiled and vaporized, and vapor will be exhausted out through the vapor vents bored in the upper sidewalls of the quartz external tube to get into the machine body to heighten the vapor pressure in the machine body, having effect of increasing pressure for facilitating outflow of hot water.

While the preferred embodiment of the invention has been described above, it will be recognized and understood that various modifications may be made therein and the appended claims are intended to cover all such modifications that may fall within the spirit and scope of the invention.

What is claimed is:

1. A vertical water heater comprising a machine body installed therein with a plurality of quartz heating tubes, each said quartz heating tube having its lower sidewall bored with water intakes and its upper wall bored with vapor vents, said machine body having its lower side provided with a water inlet and a water outlet and its upper side provided with an exhaust vent, said exhaust vent disposed thereon with a pressure release valve communicating with said exhaust vent.

2. The vertical water heater as claimed in claim 1, wherein said machine body has its external wall provided with a heat-preserving sandwich layer.

3. The vertical water heater as claimed in claim 1, wherein said machine body is transversely provided with a support frame in the interior, and said support frame and the lower side of said machine body are respectively and correspondingly secured with plural assembling bases, each said quartz heating tube fixed on said assembling bases, respectively.

4. The vertical water heater as claimed in claim 1, wherein each said quartz heating tube is composed of an quarts external tube with its opposite ends sealed, and a quartz internal tube positioned in said quartz external tube, said quartz internal tube installed therein with a remote-infrared-ray heating member and connected with an electrode terminal.

5. The vertical eater heater as claimed in claim 1, wherein said machine body has its underside secured with foot bases.

6. The vertical water heater as claimed in claim 1, wherein said machine body has its outer surface provided thereon with a pressure meter, a water level meter and a temperature meter.

7. The vertical water heater as claimed in claim 1, wherein said water inlet of said machine body communicates with a water intake tube in said machine body, said water intake tube having its lower end formed with an expanded portion bored with numerous through holes in its side wall, said water intake tube having its top end communicating with a transverse tube, said transverse tube assembled with a plurality of spraying members communicating with said transverse tube.

8. The vertical water heater as claimed in claim 1, wherein said water outlet of said machine body communicates with a water outflow tube in said machine body, said water outflow tube being a conical one with a wide upper portion and a narrow lower portion, said water outflow tube having its wall bored with numerous through holes gradually increased in number from the lower portion to the upper portion.

* * * * *